US005586349A

United States Patent [19]

Hannant

[11] Patent Number: 5,586,349

[45] Date of Patent: Dec. 24, 1996

[54] TROLLEYS

[75] Inventor: Keith Hannant, Rustington, England

[73] Assignee: Smiths Industries Public Limited Company, London, England

[21] Appl. No.: 390,518

[22] Filed: Feb. 17, 1995

[30] Foreign Application Priority Data

Mar. 4, 1994 [GB] United Kingdom ..... 9404181

[51] Int. Cl.[6] ..... A47B 9/10; A47C 19/04

[52] U.S. Cl. ..... 5/614; 5/610

[58] Field of Search ..... 5/11, 610, 611, 5/614

[56] References Cited

U.S. PATENT DOCUMENTS

| | | | |
|---|---|---|---|
| 3,754,749 | 8/1973 | Lyon et al. | 5/618 |
| 3,845,946 | 11/1974 | Warden et al. | 5/600 |
| 3,868,103 | 2/1975 | Pageot et al. | 5/614 |
| 3,896,704 | 7/1975 | Barud et al. | 5/618 |
| 4,025,972 | 5/1977 | Adams et al. . | |
| 4,038,709 | 8/1977 | Kerwit | 5/601 |
| 4,186,917 | 2/1980 | Rais et al. | 5/614 |
| 4,195,829 | 4/1980 | Reser | 5/614 |
| 4,567,894 | 2/1986 | Bergman | 5/81.1 |
| 4,865,303 | 9/1989 | Holl | 5/614 |
| 4,912,787 | 4/1990 | Bradcovich | 5/611 |

FOREIGN PATENT DOCUMENTS 2250189 6/1992 United Kingdom .

*Primary Examiner*—Steven N. Meyers
*Assistant Examiner*—Robert G. Santos
*Attorney, Agent, or Firm*—Pollock, Vande Sande & Priddy

[57] ABSTRACT

A patient transfer trolley has a pivoted top mounted at the upper end of an hydraulic support column of adjustable height. Two hydraulic cylinders connected to one end of the table top are connected to respective hydraulic pumps mounted at opposite ends of the trolley base so that angle of the top can be altered and either end can be put into a Trendelenburg position. A third pump is connected to both the support column and the cylinders for adjusting the angle of the top. An overpressure valve diverts pressure from the third pump initially to the cylinders for adjusting the angle so that the top is returned to a horizontal position. The valve then opens to allow pressure to flow to the support column and raise the trolley top.

5 Claims, 2 Drawing Sheets

TROLLEYS

BACKGROUND OF THE INVENTION

This invention relates to trolleys.

The invention is more particularly concerned with patient transfer trolleys for moving patients to and from an operating theater.

Patient transfer trolleys need to serve various functions. The height of the trolley should be adjustable so that the patient can be moved easily from the trolley to the operating table or bed. Also, it is desirable that the trolley can be put in an emergency Trendelenburg position, if necessary, in which the head of the patient is lowered with respect to his feet. Because the patient might be placed on the trolley with his head at either end, it is preferable that the trolley can be moved into the Trendelenburg position, in either sense.

Examples of patient transfer trolleys are described in GB2277870.

BRIEF SUMMARY OF THE INVENTION

It is an object of the present invention to provide an improved trolley.

According to one aspect of the present invention there is provided a trolley having a top surface, a base, a support column supporting the top surface above the base, means for altering the angle of the top surface relative to the support column, and means for altering the height of the support column arranged such that increasing the height of the support column causes the top surface to move to a horizontal position.

The means for altering the height of the support column preferably includes an hydraulic actuator and pump means. The means for altering the angle of the top surface preferably includes an hydraulic actuator and pump means. The means for altering the height of the support column may be arranged initially to supply hydraulic fluid to the actuator for altering the angle of the top surface and subsequently to supply hydraulic fluid to the actuator for altering the height of the support column. The trolley may include an overpressure valve that initially diverts fluid to the actuator for altering the angle of the top surface and changes state when the top surface is horizontal to divert fluid to the actuator for altering the height of the support column. The overpressure valve is preferably connected between the pump for altering the height of the support column and the hydraulic actuator of the support column, an hydraulic line connecting the pump for altering the height of the support column to the actuator for altering the angle of the top surface, the overpressure valve being closed at low pressure so that fluid flows to the actuator for altering the angle of the top surface until the top surface is horizontal, and the pressure increasing after the top surface is horizontal thereby causing the overpressure valve to open and allowing fluid to flow to the hydraulic actuator of the support column. The means for altering the angle of the top surface may include two hydraulic actuators arranged to alter the angle of the top surface in opposite senses. The two hydraulic actuators are preferably coupled together in opposition to one another. The two hydraulic actuators are preferably connected to respective hydraulic pumps mounted towards opposite ends of the trolley.

A patient trolley in accordance with the present invention, will now be described, by way of example, with reference to the accompanying drawings.

DETAILED DESCRIPTION OF THE PREFERRED EMBODIMENT

Figure 1:
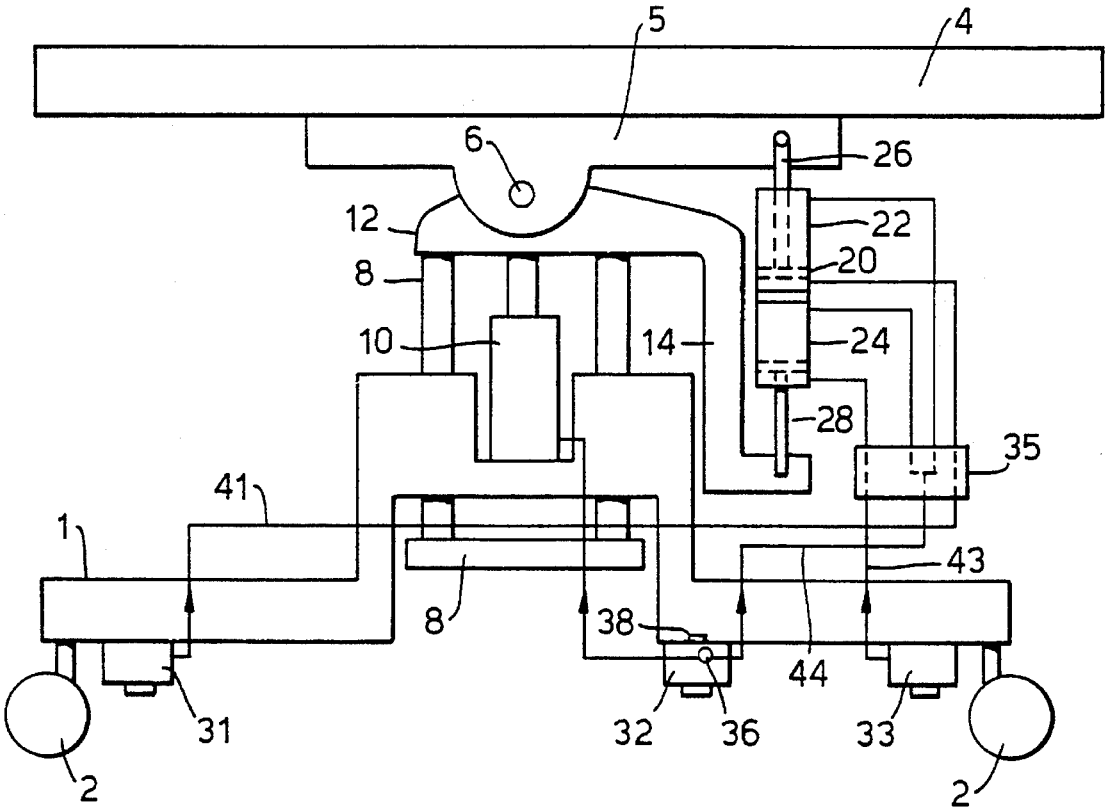
FIG. 1 is a simplified side elevation view of the trolley.

With reference first to FIG. 1, the trolley has a base assembly 1 with wheels or castors 2 by which the trolley can be moved over the floor. The patient support top 4 is removably mounted on a frame 5. The frame 5 is mounted at a pivot 6 approximately midway along the length of the top 4, at the upper end of a vertical slide mechanism 8. The lower end of the slide mechanism 8 is slidable up or down with respect to the base assembly 1. A vertical hydraulic cylinder 10 is mounted at its lower end on the base assembly 1 and is connected at its upper end to the slide mechanism 8. The slide mechanism 8, together with the hydraulic cylinder 10, forms a support column 12 of adjustable height so that the height of the top 4 relative to the base assembly 1 can be altered.

The slide mechanism 8 has a downwardly-extending side arm 14 on the lower end of which is mounted an hydraulic Trendelenburg actuator assembly 20. The upper end of the actuator assembly 20 is pivotally connected to the trolley top frame 5, to the right of its pivot 6. The actuator assembly 20 comprises two hydraulic actuator cylinders 22 and 24 connected together, back-to-back. In the position shown, with the top 4 horizontal, the piston 26 of the upper cylinder 22 is fully retracted and the piston 28 of the lower cylinder 24 is fully extended.

On the base assembly 1, there are three foot-operated hydraulic pumps 31, 32 and 33 by which the height and angle of the trolley top 4 can be altered. The pumps 31 and 33 are located at the left-hand end and right-hand end of the base assembly 1 respectively. The other pump 32 is located between the two pumps 31 and 33. The left-hand pump 31 is connected via a fluid line 41 and a valve block 35 to the lower, closed end of the upper cylinder 22 so that, when the pump is operated, it causes the piston 26 to extend, thereby increasing the overall length of the actuator assembly 20. This raises the height of the top 4 at its fight-hand end and lowers its left-hand end.

The right-hand pump 33 is connected to the lower, annulus end of the lower cylinder 24 via a fluid line 43 and the valve block 35 so that, when the pump is operated, it causes the piston 28 to retract, thereby lowering the fight-hand end of the top 4.

The central pump 32 is connected via a fluid line 44 and the valve block 35 to the upper, closed end of the lower cylinder 24 and to the upper, annulus end of the upper cylinder 22. The pump 32 is also connected via an overpressure valve 36 to the closed, lower end of the hydraulic cylinder 10 in the column 12. When the central pump 32 is operated, fluid is supplied initially only to the actuator assembly 20, the over-pressure valve 36 remaining closed. This pressure causes the lower piston 28 to fully extend and the upper piston 26 to fully retract if they are not already in these positions. Further operation of the pump 32 cannot cause any further movement of the pistons 26 and 28 so pressure builds up until the over-pressure valve 36 opens and allows pressure to be supplied to the column actuator 10. This causes the column actuator 10 to extend and raises the top 4 of the trolley. In this way, the top 4 is always brought to a horizontal position before its height is increased. When the user wishes to lower the top 4, he depresses a release valve 38 on the pump 32.

Figure 2:
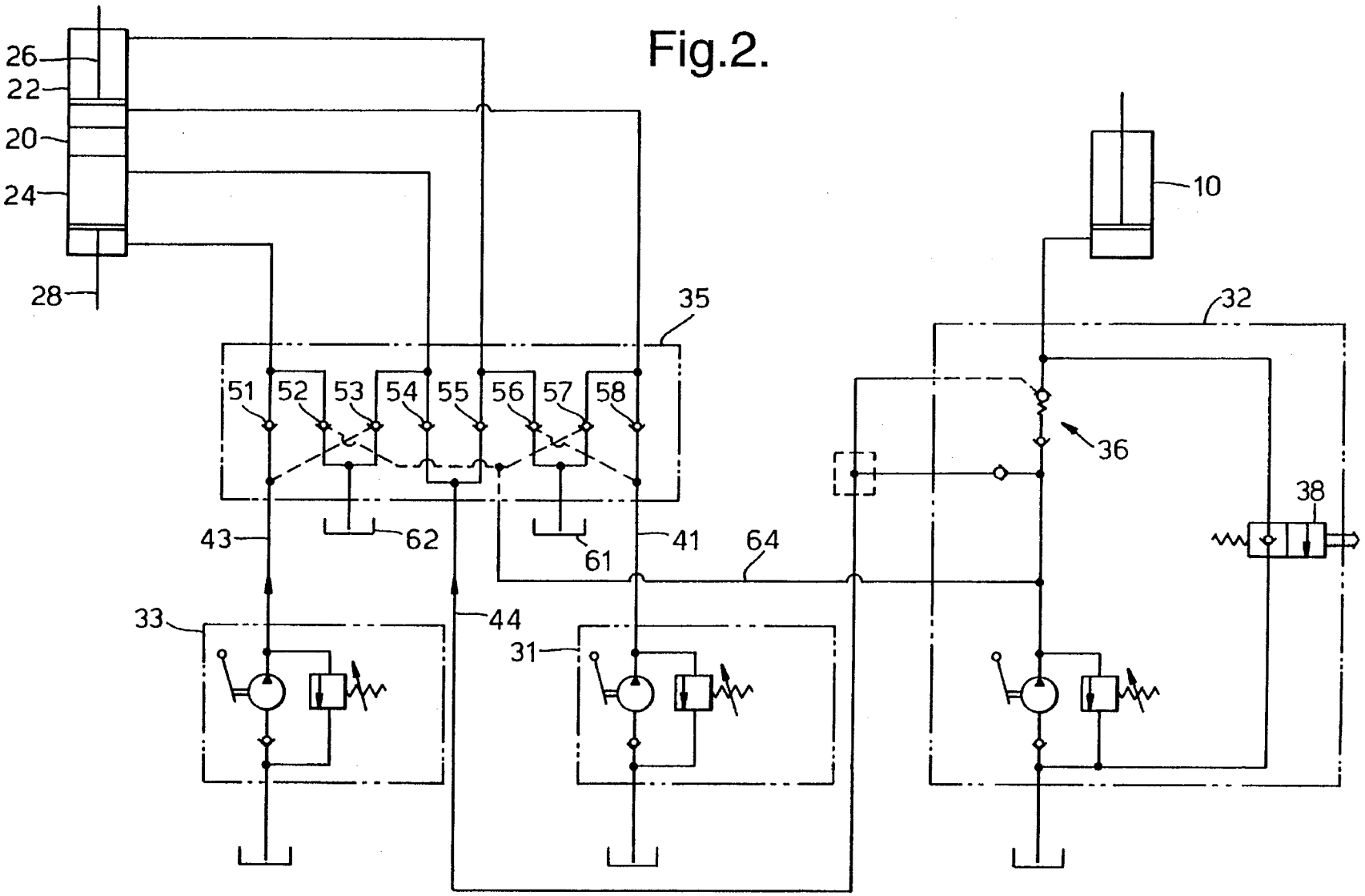
FIG. 2 shows the hydraulic circuit of the table in greater detail.

With reference now to FIG. 2, the valve block 35 can be seen to include eight one-way valves 51 to 58. The fluid line 41 from the pump 31 is connected directly to the one-way valve 58 and is coupled to valve 56 so that pressure in line 41 causes valve 56 to open. In this way, fluid flows from the pump 31 to the cylinder 22 via valve 58, and flows out of the cylinder via valve 56 to a reservoir 61. Similarly, fluid from pump 33 flows to cylinder 24 via valve 51 and returns via valve 53 to a reservoir 62. When fluid is supplied to the actuator 20 from the pump 32 it flows via line 44 and valves 54 and 55 respectively to the cylinders 24 and 22. Fluid pressure is also supplied from the pump 32 via line 64 to the valve block 35 where it is coupled to open valves 52 and 57. Valve 52 is connected between the lower end of the lower cylinder 24 and the reservoir 62 so that, when open, fluid flows from the cylinder to the reservoir. Valve 57 is connected between the lower end of the cylinder 22 and the reservoir 61 so that, when open, fluid can flow from the cylinder to the reservoir.

If the patient were lying on the trolley with his head at the left-hand end, in an emergency, the top 4 could readily be moved into the correct Trendelenburg position by operation of the left-hand pump 31. Similarly, if the patient were lying in the opposite orientation, his head could be lowered by operation of the right-hand pump 33. The trolley of the present invention is, therefore, easy to use correctly in an emergency. By ensuring that the top is automatically placed in a horizontal position before raising, this simplifies use of the trolley.

What I claim is:

1. A trolley comprising: a base; a support column; a first mechanism for altering the height of the support column; a top surface supported by said column above said base; a second mechanism for altering the angle of said top surface relative to said support column, said first and second mechanisms being so interconnected that the height of said support column cannot be increased without automatically causing said top surface to move to a horizontal position; said first mechanism including an hydraulic actuator and a pump, said first mechanism being operative to initially supply hydraulic fluid to an actuator in said second mechanism for altering the angle of said top surface and to subsequently supply hydraulic fluid to said actuator in said first mechanism for altering the height of said support column; said trolley including an overpressure valve, an hydraulic line connecting said valve between said pump and said actuator in said first mechanism, an hydraulic line connected between said pump and said actuator in said second mechanism, said overpressure valve being closed at low pressure such that fluid from said pump flows to said actuator in said second mechanism until said top surface is horizontal, and wherein fluid pressure increases after said top surface is horizontal thereby causing said valve to open and to allow fluid to flow to said actuator in said first mechanism.

2. A trolley comprising: a base; an hydraulic support column that can be altered in height; a first hydraulic pump; an hydraulic line connecting said first pump to the support column;

a top surface supported by said column above said base; two hydraulic actuators connected in opposition to one another between the top surface and the support column;

second and third hydraulic pumps; means connecting said second and third pumps to respective ones of said hydraulic actuators such that actuation of said hydraulic pumps alters the angle of the top surface in opposite senses; and means connecting said first pump to said hydraulic actuators such that actuation of said first pump initially supplies fluid to one of said hydraulic actuators to move said top surface to a horizontal position before the height of the support column is increased.

3. A trolley according to claim 2, wherein said second and third pumps are mounted towards opposite ends of the trolley.

4. A trolley according to claim 2, including an overpressure valve connected in said hydraulic line, a second hydraulic line connected between said two actuators and said first pump, wherein said overpressure valve is closed at low pressure such that fluid from said first pump flows via said second hydraulic line to one of said actuators until said top surface is horizontal, and wherein pressure increases after said top surface is horizontal thereby causing said valve to open and allowing fluid to flow to said support column.

5. A trolley comprising: a base; a support column; a first mechanism including an hydraulic actuator for altering the height of the support column; a top surface supported by said column above said base; a second mechanism including another hydraulic actuator for altering the angle of said top surface relative to said support column, said first and second mechanisms being so interconnected that the height of said support column cannot be increased without automatically causing said top surface to move to a horizontal position, said first mechanism being operative to initially supply hydraulic fluid to the actuator in said second mechanism and to subsequently supply hydraulic fluid to the actuator in said first mechanism, said trolley including pump means and an overpressure valve, an hydraulic line connecting said valve between said pump means and the actuator in said first mechanism, an hydraulic line connected between said pump means and the actuator in the second mechanism, said overpressure valve being closed at low pressure such that fluid flows to said actuator in the second mechanism for altering the angle of said top surface until said top surface is horizontal, and wherein pressure increases after said top surface is horizontal thereby causing said valve to open and allow fluid to flow to said actuator in the first mechanism for altering the height of said support column.

* * * * *